US006480165B2

(12) United States Patent
Moheb et al.

(10) Patent No.: US 6,480,165 B2
(45) Date of Patent: Nov. 12, 2002

(54) MULTIBEAM ANTENNA FOR ESTABLISHING INDIVIDUAL COMMUNICATION LINKS WITH SATELLITES POSITIONED IN CLOSE ANGULAR PROXIMITY TO EACH OTHER

(75) Inventors: Hamid Moheb, Clemmons, NC (US); Colin Michael Robinson, Conover, NC (US)

(73) Assignee: Prodelin Corporation, Newton, NC (US)

( * ) Notice: Subject to any disclaimer, the term of this patent is extended or adjusted under 35 U.S.C. 154(b) by 38 days.

(21) Appl. No.: 09/797,321

(22) Filed: Mar. 1, 2001

(65) Prior Publication Data

US 2001/0028330 A1 Oct. 11, 2001

Related U.S. Application Data

(60) Provisional application No. 60/186,245, filed on Mar. 1, 2000.

(51) Int. Cl.[7] ..... H01Q 13/00

(52) U.S. Cl. ..... 343/781 R; 343/761; 343/762; 343/776; 343/786; 343/DIG. 2

(58) Field of Search ..... 343/753, 754, 343/755, 761, 762, 765, 776, 781 R, 786, 839, 840, DIG. 2; H01Q 13/00

(56) References Cited

U.S. PATENT DOCUMENTS

| | | | | |
|---|---|---|---|---|
| 4,008,477 A | | 2/1977 | Babij et al. | |
| 4,224,622 A | * | 9/1980 | Schmidt | 343/853 |
| 4,607,260 A | | 8/1986 | Dragone | |
| 4,608,573 A | * | 8/1986 | Paullin | 343/894 |
| 4,821,046 A | | 4/1989 | Wilkes | |
| 4,901,369 A | * | 2/1990 | Momose et al. | 455/84 |
| 5,136,294 A | | 8/1992 | Iwata | |
| 5,216,432 A | | 6/1993 | West | |
| 5,276,410 A | * | 1/1994 | Fukuzawa et al. | 333/21 A |
| 5,309,167 A | | 5/1994 | Cluniat et al. | |
| 5,420,599 A | | 5/1995 | Erkocevic | |
| 5,434,586 A | | 7/1995 | Kinoshita et al. | |
| 5,459,441 A | | 10/1995 | Weber et al. | |
| 5,463,406 A | | 10/1995 | Vannatta et al. | |
| 5,463,407 A | | 10/1995 | West et al. | |

(List continued on next page.)

FOREIGN PATENT DOCUMENTS

| | | |
|---|---|---|
| EP | 0 644 608 A2 | 3/1995 |
| EP | 0 805 511 A2 | 11/1997 |
| FR | 2 793 073 | 11/2000 |

OTHER PUBLICATIONS

H. Moheb, C. Robinson, J. Kijesky, *Design & Development of Co–Polarized Kuband Ground Terminal System for Very Small Aperture Terminal (VSAT) Application, IEEE Antennas and Propagation Society International Symposium*, 1999 Digest, Jul. 11–16, 1999, vol. 3, 1999, pp. 2158–2161, Orlando, Florida.

*Primary Examiner*—Tho Phan
(74) *Attorney, Agent, or Firm*—Alston & Bird LLP

(57) ABSTRACT

Antennas and multiplexer structures are provided for establishing individual communication links with satellites that are located at geostationary positions in close angular proximity to one another. The antenna includes individual wave-guides where at least one of the wave-guides has a decreased dimension such that the wave-guides may be spaced in close proximity to each other to communicate with the satellites. For example, in one embodiment, the antenna includes at least one wave-guide that is a hollow metallic structure filled with a dielectric material. The dimensions of this wave-guide can be altered by changing the dielectric material used to fill the wave-guide. By using a dielectric material having an appropriate dielectric constant, the dimension of the wave-guide can be configured to allow the wave-guide to be spaced in close proximity to the other wave-guide.

33 Claims, 7 Drawing Sheets

U.S. PATENT DOCUMENTS 5,495,258 A 2/1996 Muhlhauser et al.
5,534,881 A 7/1996 Young et al.
5,550,554 A 8/1996 Erkocevic
5,557,291 A * 9/1996 Chu et al. ..... 343/725
5,578,972 A 11/1996 Tilford
5,635,944 A * 6/1997 Weinstein et al. ..... 343/776
5,686,923 A 11/1997 Schaller
5,686,926 A 11/1997 Kijima et al.
5,737,698 A 4/1998 Gabrelian et al.
5,805,116 A 9/1998 Morley
5,812,096 A 9/1998 Tilford
5,831,582 A 11/1998 Muhlhauser et al.
5,870,060 A 2/1999 Chen et al.
5,870,062 A * 2/1999 Cox ..... 343/781
6,018,276 A 1/2000 Hirota et al.
6,031,505 A 2/2000 Qi et al.
6,211,842 B1 4/2001 Cousin et al.

* cited by examiner

MULTIBEAM ANTENNA FOR ESTABLISHING INDIVIDUAL COMMUNICATION LINKS WITH SATELLITES POSITIONED IN CLOSE ANGULAR PROXIMITY TO EACH OTHER

CROSS-REFERENCE TO RELATED APPLICATIONS

The present application claims priority from U.S. Provisional Application Ser. No. 60/186,245 entitled MULTIBEAM ANTENNA FOR TRANSMITTING AND/OR RECEIVING SIGNALS FROM MULTIPLE TRANSMISSION AND RECEIVING SOURCES THAT ARE LOCATED IN CLOSE PROXIMITY TO EACH OTHER, filed Mar. 1, 2000, the contents of which are incorporated herein by reference.

FIELD OF THE INVENTION

The present invention relates generally to an antenna for establishing communication with multiple transmitting and receiving sources, such as satellites. More particularly, the multibeam antenna of the present invention relates to an antenna for establishing communication with satellites which are located at geostationary positions that are in close angular proximity to each other.

BACKGROUND OF THE INVENTION

In recent years, there has been a significant increase in the amount and types of information that is transmitted via satellite communication. For instance, satellites now transmit telephone signals, television signals, and Internet data, etc. Due to the expanded use of satellites for data communication, there has also been an associated increase in the number of satellites placed in orbit about the earth. For instance, there are currently satellites that are dedicated to transmission of not only television signals in general, but are dedicated to transmission of only certain types of programming, such as movie channels, foreign language channels, local channel programming, or high definition television signals. Further, satellites have been deployed for Internet communication.

Due to the increasing amount of information and services that are offered via satellite communication, there exists a current need for an integrated antenna that can transmit and receive signals to and from different satellites each located at different geostationary positions, such that a user is not required to use multiple antennas. This, however, presents an increasing problem with the introduction of additional satellites into orbit for different types of data communication. As more satellites are introduced into orbit, the angular spacing between the satellites will decrease. In fact, currently there are several satellites that are positioned within a range of 5 degrees or less of arc with respect to each other. The proximity of these satellites to each other is somewhat problematic from the standpoint of using one antenna to establish individual communication links with both of these satellites.

Specifically, to communicate with multiple satellites, an antenna will typically include individual antenna elements, referred to as feeds or more generally, wave-guides, where each feed is dedicated to communicating with one of the satellites. Because of the closeness in angular proximity of some satellites, these wave-guides should be placed in close proximity to each other on the antenna to properly communicate with their respective satellites. The problem is that many conventional corrugated wave-guide designs cannot be used, because of the reduced spacing required between the phase centers of the wave-guides needed to receive from and transmit signals to the satellites is such that the conventional individual wave-guides would occupy overlapping space due to their size.

This problem is more clearly illustrated with reference to FIGS. 1A and 1B. FIG. 1A illustrates a typical satellite system 10 having two satellites, 12 and 14, located at geostationary positions that are a particular arc distance 16 apart. The satellite system further includes either one or a plurality of ground-based antennas, 18–22, for communication with these satellites. In particular, each of the ground-based antennas typically includes a reflector 22 directed toward the satellites. Each of the antennas also includes respective individual wave-guides, 24 and 26, for establishing communication links with the individual satellites. The wave-guides are positioned with respect to the reflector so that signals 28 received from the satellite associated with the wave-guides are directed by the reflector to the wave-guides and signals from the wave-guides are directed by the reflector to the associated satellite. As the wave-guides are positioned with respect to the reflector to receive signals from and transmit signals to their associated satellite, problems occur when the satellites with which the individual wave-guides respectively communicate are located in close angular proximity to each other.

Specifically, FIG. 1B shows two signals, 30 and 32, respectively transmitted by two individual satellites to an antenna 34. In this illustration, the reflector 36 of the antenna is directed at a first satellite, and the signals 30 from this satellite are reflected by the reflector to a focal point 38 in front of the reflector. Further, the signals 32 received from the second satellite are directed by the reflector to a second point 40 in front of the reflector. In this instance, the wave-guide 42 associated with the first satellite is located at the focal point 38, and the wave-guide 44 associated with the second satellite is located at the second point 40 to thereby establish respective communication links with the satellites.

As can be seen, there is an offset distance 46 between the wave-guides. This offset distance is determined by the angular difference between the geostationary positions of the satellites. If the satellites are located at geostationary positions that are farther apart angularly, then there will be a larger offset distance 46 between the wave-guides. However, the closer the satellites are positioned with respect to each other, the smaller the offset distance 46 becomes. At some point, typically when the satellites are spaced apart by an angular distance of 5° or less, the offset distance between the wave-guides becomes sufficiently small, such that many conventional corrugated wave-guide designs cannot be used. Specifically, the spacing required between the phase centers of the wave-guides to properly receive and transmit signals to the satellites is such that the conventional individual wave-guides would occupy overlapping space due to their size.

To address this problem, an antenna system has been designed to allow for more closely spaced receive feeds, as described in U.S. Pat. No. 5,812,096 to Tilford. With reference to FIG. 2, this antenna system 50 includes a reflector 52 and a feed system in which two conventional receive feeds, 54 and 56, have been modified such that they may be spaced a reduced distance apart. This feed configuration is referred to as a siamese feed, in which a section of the housing for each conventional feed has been cutaway so that the feeds may be spaced closer together. The siamese feed allows for reception of signals, 30 and 32, from two closely spaced satellites.

Although the siamese feed of this antenna system allows for communication with closely spaced satellites, it does have some drawbacks. For example, first the siamese feed does not use standard wave-guides. Instead, the wave-guides must be modified by removing a portion of their housing. This, in turn, may increase manufacturing time and cost.

Further, the siamese feed system does not provide a solution for antennas that establish two-way communication with satellites. This is a significant limitation of the siamese feed system. Specifically, certain commercial systems employ one satellite used for Internet communication and in close proximity to this particular satellite is another satellite used for transmission of high definition television. Since the siamese feed system only includes receive wave-guides, and not a bidirectional wave-guide for two-way communication, it would not be suitable for this antenna application.

An added problem with placement of wave-guides in close proximity to each other, besides physical size limitations, not addressed by the siamese feed system is signal isolation concerns. Specifically, in applications in which the antenna is used in a two-way communication application, signals transmitted from a bi-directional wave-guide to a satellite are also broadcast to the area surrounding the wave-guide. If a second wave-guide is positioned in close proximity to communicate with another closely angular spaced satellite, the transmission signals from the first wave-guide may be received by the second wave-guide, thereby possibly disrupting communication between the closely spaced second wave-guide and its associated satellite.

SUMMARY OF THE INVENTION

As set forth below, the present invention provides antennas and multiplexer structures that overcome many of the identified deficiencies and several additional deficiencies associated with establishing communication with satellites that are positioned in close angular proximity to each other. Specifically, the antennas and multiplexer structures of the present invention include wave-guides that can be spaced in close proximity to each other so as to establish data communication with satellites that are located in close angular proximity to each other. As such, the present invention may provide an antenna having one reflector and multiple wave-guides for data communication with a plurality of satellites, including satellites that are in close proximity to one another, such that a user may establish desired communication links with the different satellites without the need for additional antennas.

In addition, the present invention also provides antennas and multiplexer structures that may be manufactured at a reduced cost. Specifically, in some embodiments of the present invention, the antenna and multiplexer structures use commercially available wave-guides that do not require substantial modification prior to use. As such, manufacturing time and cost may be reduced. Further, the antennas and multiplexer structures of the present invention use isolation structures and methods that reduce the propagation of signals transmitted by one closely spaced feedhorn section of a wave-guide from propagating along the receive wave-guide section of an adjacent wave-guide. They also prevent transmit signals transmitted on the transmit wave-guide section of a wave-guide from propagating along the receive wave-guide section of the wave-guide and signals received by the feedhorn section of the wave-guide from propagating along the transmit wave-guide section associated with the wave-guide.

These and other advantages are provided according to one embodiment of the present invention by an antenna for establishing individual communication links with at least first and second satellites located at different geostationary positions and in close angular proximity to each other. The antenna of this embodiment includes a reflector that directs signals transmitted to and from the first and second satellites. It also includes a first wave-guide positioned with respect to the reflector for establishing a communication link with the first satellite and a second wave-guide positioned with respect to the reflector for establishing a communication link with the second satellite. Importantly, the first and second wave-guides of the antenna are positioned in close proximity with respect to each other so as to establish respective communication links with the closely angular spaced first and second satellites, thereby allowing one antenna to be used to communicate with two closely spaced satellites.

For example, in one embodiment of the present invention, the antenna includes at least one wave-guide that has a dielectric constant greater than that of air. In this embodiment, the dimension of the wave-guide can be controlled or varied in accordance with the dielectric material from which the wave-guide is formed. Specifically, the wave-guide can be decreased in size by using the proper dielectric material such that it may be placed in closer proximity to the other wave-guide. For example, in one embodiment, the wave-guide is formed of a hollow tubular metallic conduit that is filled with a solid dielectric material having a dielectric constant greater than that of air. Since the diameter of the wave-guide for a given frequency is inversely proportional to the square root of the dielectric constant of the material with which the hollow tubular metallic conduit is filled, the diameter of the wave-guide can be decreased by filling the wave-guide with a dielectric material having a higher dielectric constant. By decreasing the diameter of the wave-guide, it can be placed in closer proximity to an adjacent wave- guide so that the wave-guides can establish respective communication links with closely spaced satellites.

In one embodiment, the satellite may be used to form one-way communication links with two closely spaced satellites, where signals from the satellites are received by individual wave-guides. In this embodiment, either one or both of the wave-guides are hollow tubular metallic conduits that are filled with a solid dielectric material having a desired dielectric constant to give the wave-guides proper diameters, such that they be placed in close proximity to one another.

As an example, in one embodiment of the present invention, the first and second satellites are located at geostationary positions that are spaced in a range of 5 degrees or less of arc apart. In this embodiment, in order to establish respective communication links with the satellites, the multibeam antenna includes first and second wave-guides that are positioned within up to 2 inches apart, measured from an axis of the first wave-guide to an axis of the second wave-guide.

In another embodiment, at least one of the first and second wave-guides of the antenna is capable of creating a two-way communication link with its respective satellite, in which the wave-guide both receives signals from and transmits signals to the satellite. As mentioned above, the antenna and multiplexer structure of the present invention can use commercially available wave-guides, which may decrease manufacturing time and cost. As such, in one embodiment, the first wave-guide of the antenna and multiplexer structure of the present invention is a corrugated hollow wave-guide capable of performing two-way communication with the first satellite. The corrugated hollow wave-guide has a width that allows the second wave-guide of the antenna to be positioned in close proximity to the first wave-guide to establish a communication link with the second satellite. In a further embodiment, the corrugated hollow wave-guide is a rectangular corrugated hollow wave-guide having a height of less than three (3) inches and a width of less than an inch and one half (1½) inches.

In addition to using a corrugated hollow wave-guide for two-way communication with the first satellite, the antenna and multiplexer structure of the present invention may also use a second wave-guide that is dimensioned such that it may be placed in closer proximity to the first feed. For example, in one embodiment, the antenna and multiplexer structure of the present invention includes a second wave-guide for establishing communication with a second satellite, which is a hollow tubular metallic conduit that is filled with a solid dielectric material. The second wave-guide of this embodiment has a dimension that is inversely related to the square root of the dielectric material with which the wave-guide is filled. As such, by using a dielectric material having an increased dielectric constant, the size of the wave-guide can be reduced.

As mentioned above, in addition to antennas, the present invention also provides multiplexer structures for mounting and positioning the wave-guides relative to the reflector of the antenna. Specifically, in one embodiment, the present invention provides a multiplexer structure having first and second feedhorn sections positioned in close proximity to one another. The first feedhorn section is a hollow tubular metallic structure and the second feedhorn section is a hollow tubular metallic conduit that is filled with a solid dielectric material. The multiplexer structure further includes a receive wave-guide section in communication with each respective feedhorn sections and a transmit wave-guide section in communication with the first feedhorn section. The receive wave-guide sections act as conduits for delivering the signals received by the feedhorn sections to respective communication units, such as a TV, computer, etc., associated with the antenna. Further, the transmit wave-guide section acts as a conduit for signals from the transmitter associated with the antenna to the first feedhorn section.

In addition to providing transmit and receive wave-guide sections, the multiplexer structure of the present invention may also provide filters connected to the transmit and receive wave-guide sections. Filters connected to the transmit wave-guide sections prevent signals received by the first feedhorn sections from propagating along the transmit wave-guide section. Further, filters connected to the receive wave-guide sections prevent signals transmitted by the feedhorn sections from propagating along the receive wave-guide sections.

In particular, typically in two-way communication satellite systems, the signals transmitted to the satellites from the transmit feeds are transmitted within a first range of frequencies and signals received from the satellites are received within a second range of frequencies. To prevent received signals from propagating along the transmit wave-guide section, in one embodiment, the multiplexer structure of the present invention includes a filter connected to the transmit wave-guide sections for filtering frequencies in the second range that are received by the feedhorn section. As such, signals received by the feedhorn section do not disrupt the transmitter. Further, and importantly, the multiplexer structure further includes filters connected to the receive wave-guide sections. These filters filter frequencies in the first range, such that signals transmitted from the first feedhorn to the satellite do not propagate along the receive wave-guide sections of the first feedhorn section. Importantly, the filters on the receive wave-guide sections not only prevent signals transmitted by the feedhorn sections from propagating along the receive wave-guide section associated with the feedhorn section, but also prevent propagation of the transmitted signal on the receive wave-guide section of feedhorns that are located adjacent to the transmitting feedhorn section that may receive the transmitted signal due to their proximity to the transmitting feedhorn section.

In some satellite system applications, it is desired to provide maximized communication performance between one of the wave-guides and its associated satellite. For example, some satellite communication systems are used for data transfer, such as Internet communication. In these instances, each bit of data transmitted must be properly received, and as such, increased connection performance is desired. In light of this, in one embodiment, the antenna of the present invention includes a wave-guide positioned such that it is directed at a focal point of the reflector. By positioning the wave-guide such that it is directed at the focal point of the reflector, the signals from the satellite to the wave-guide and signals from the wave-guide to the satellite are better focused, thereby ensuring increased communication performance. In this embodiment, because one wave-guide is positioned with respect to the focal point of the reflector, any second wave-guide is positioned at an offset distance from the first wave-guide for establishing communication with the second satellite.

BRIEF DESCRIPTION OF THE DRAWINGS

Figure 1A:
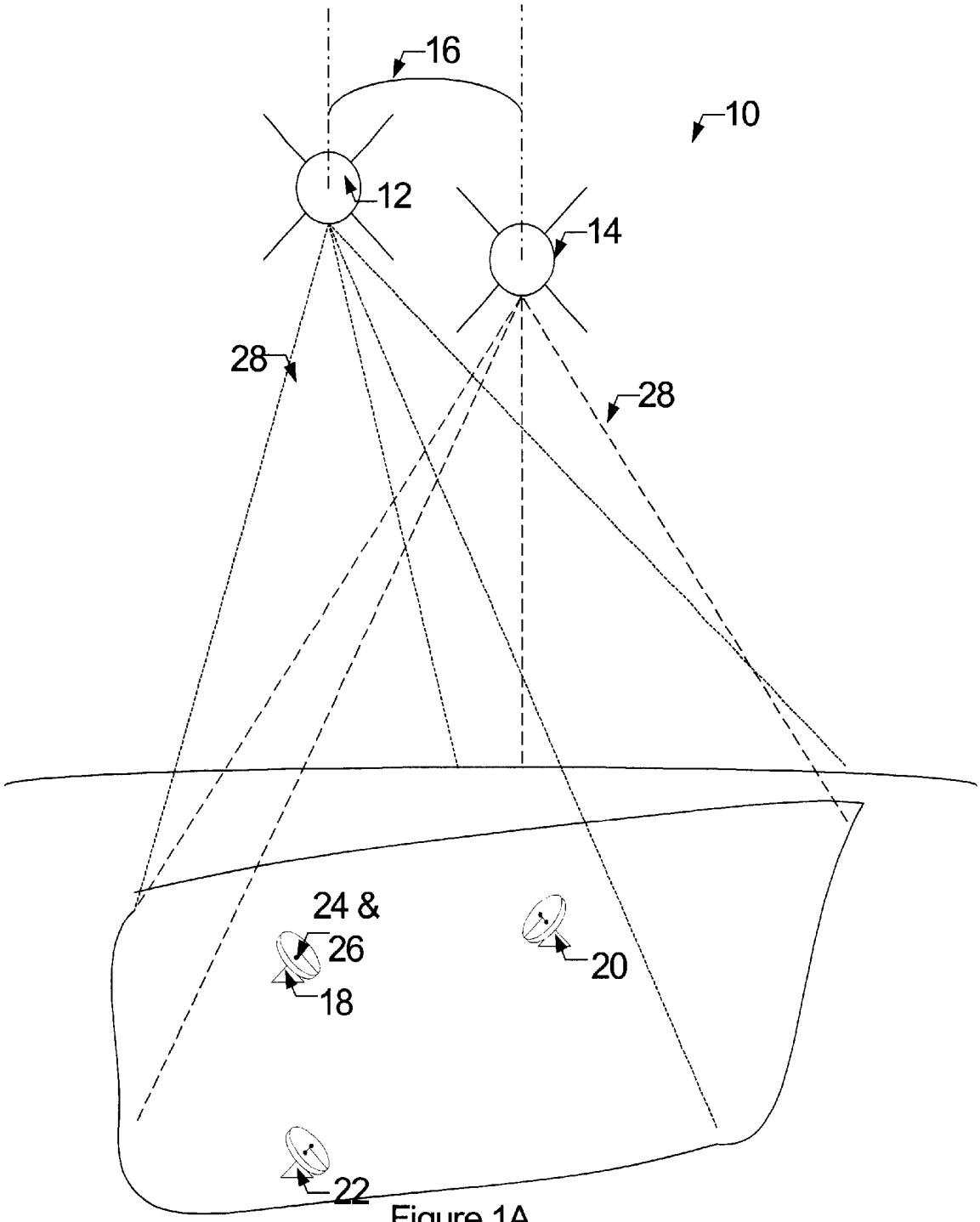
Figure 1A (Prior Art)

Having thus described the invention in general terms, reference will now be made to the accompanying drawings, which are not necessarily drawn to scale, and wherein:

FIG. 1A is a perspective view of two satellites in communication with a plurality of earth-based antennas.

Figure 1B:
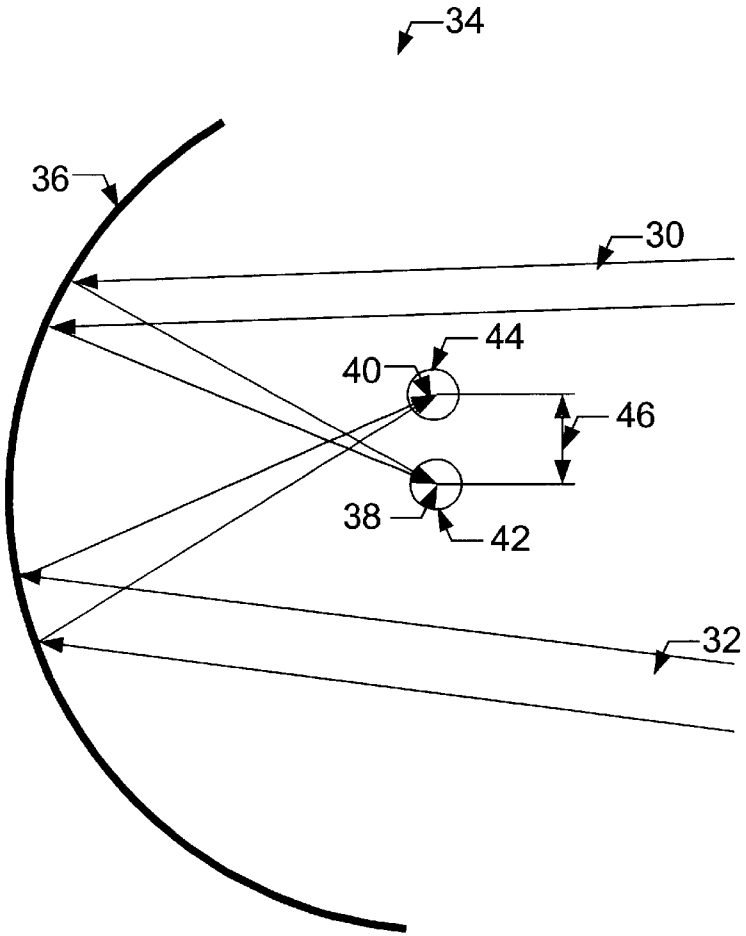
Figure 1B (Prior Art)

FIG. 1B is a diagram illustrating the placement of feeds with respect to the reflector of an antenna to receive respective signals from two satellites located at respective geostationary positions.

Figure 2:
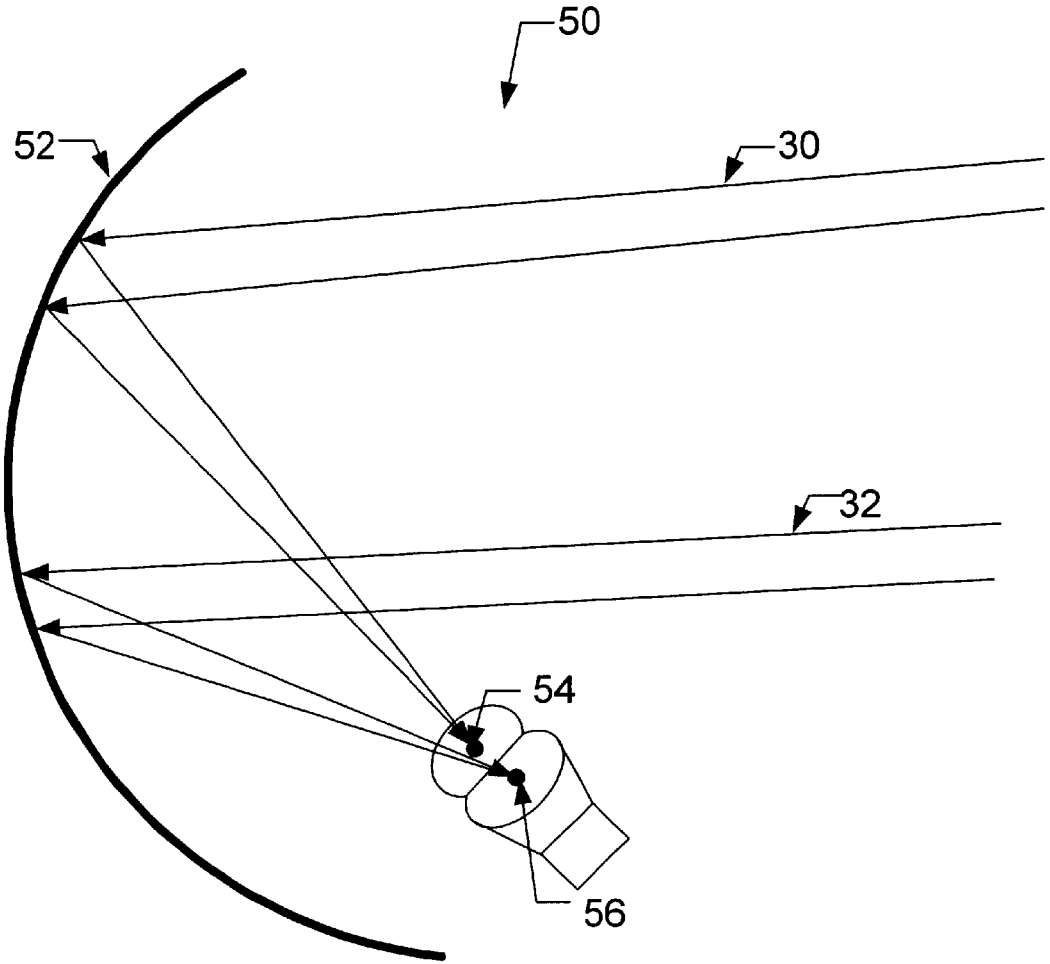
Figure 2 (Prior Art)

FIG. 2 is a diagram of a prior art antenna structure having a siamese feed structure for communication with two closely spaced satellites.

Figure 3:
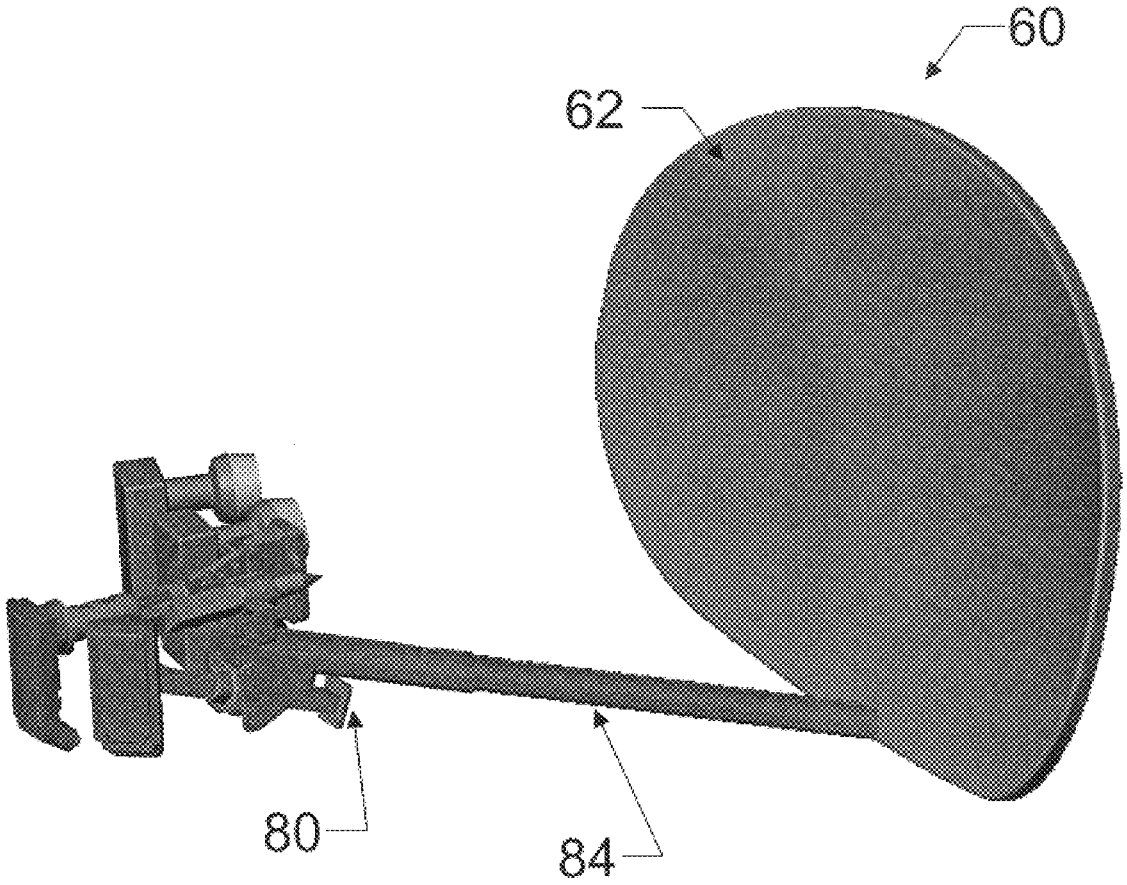

FIG. 3 is a perspective view of an antenna and multiplexer structure having two wave-guides located in close proximity to each other for establishing communication links with respective closely spaced satellites according to one embodiment of the present invention.

Figure 4A:
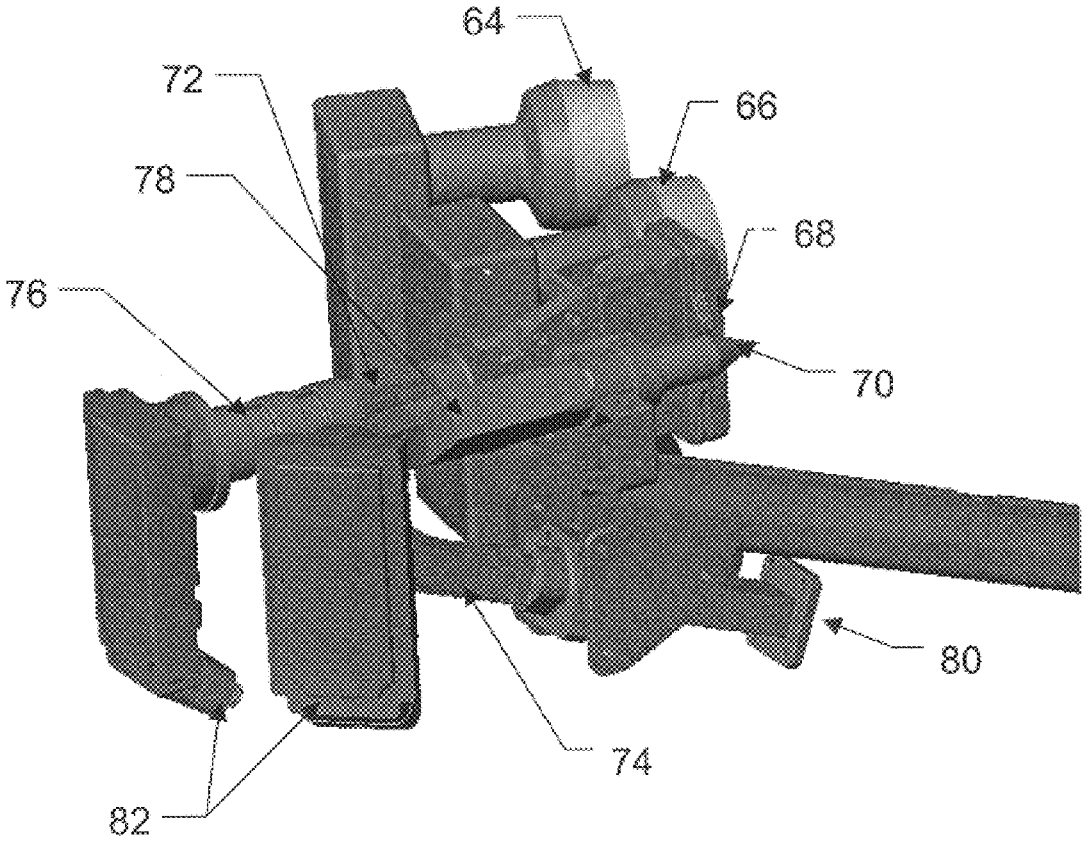
Figure 4B:
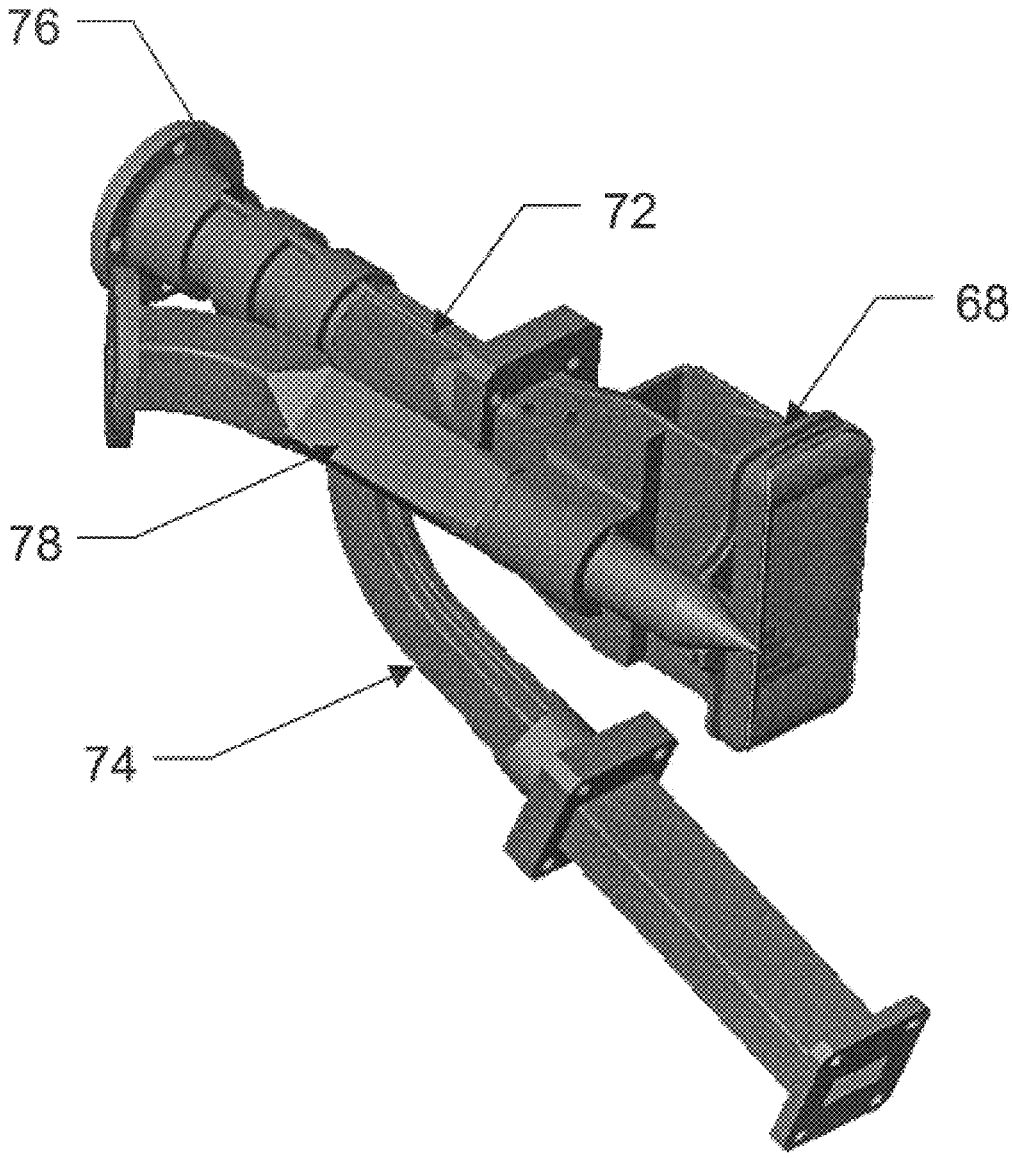

FIGS. 4A and 4B are exploded perspective views of an antenna and multiplexer structure having two wave-guides located in close proximity to each other for establishing communication links with respective closely spaced satellites according to one embodiment of the present invention.

Figure 5:
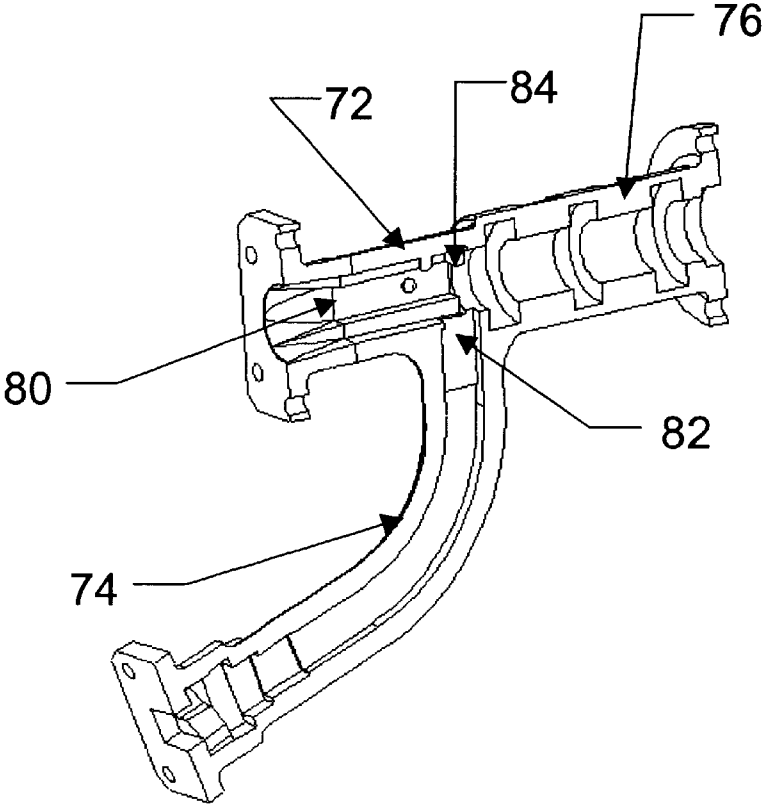

FIG. 5 is a perspective cross-sectional view of a support structure in combination with a feedhorn section and transmit and receive wave-guides to both transmit and receive data from a satellite according to one embodiment of the present invention.

DETAILED DESCRIPTION OF THE INVENTION

The present invention now will be described more fully hereinafter with reference to the accompanying drawings, in which preferred embodiments of the invention are shown.

This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As mentioned above and provided in greater detail below, the present invention provides various antennas, multiplexer structures, and methods that overcome many of the problems associated with establishing communication with satellites that are positioned in close angular proximity to each other. Specifically, the antennas and multiplexer structures of the present invention include wave-guides that can be positioned in close proximity relative to each other so as to establish data communication with satellites that are located at geostationary positions that are in close angular proximity. As such, the present invention may provide an antenna having one reflector and multiple wave-guides for data communication with a plurality of satellites, including satellites that are in close proximity to one another. Thus, a user may establish desired communication links with the different satellites without the need for additional antennas.

In addition, the antennas, multiplexer structures, and methods of the present invention use isolation structures and methods that reduce the propagation of signals transmitted by one closely spaced wave-guide from propagating along the receive wave-guide associated with an adjacent wave-guide. These isolation structures and methods also prevent transmit signals transmitted on the transmit wave-guide associated with a feedhorn section from propagating along the receive wave-guide associated with the feedhorn section and signals received by the feedhorn section from propagating along the transmit wave-guide associated with the feedhorn section.

With reference to FIGS. 3, 4A, and 4B one embodiment according to the present invention is illustrated. FIG. 3 illustrates the antenna 60 of the present invention having a reflector 62 and a plurality of wave-guides, 64, 66, 68, and 70, spaced apart from the reflector. The wave-guides, shown in FIG. 4, establish individual data communication links with different satellites located at different angular locations. For instance, the wave-guides 64 and 66 may be configured with respect to the reflector of the antenna so as to establish individual data communication links with satellites that are located at geostationary positions that are more than five (5) degrees of arc apart. As an example, these wave-guides may be positioned to communicate with respective satellites located at 101° and 110° or any other satellites that are located at geostationary positions that are sufficiently spaced apart from each other. As the angular distance between these two satellites is relatively large, the two wave-guides 64 and 66 are spaced at a sufficient axial distance apart, such that most conventional corrugated wave-guide assemblies may be used regardless of their dimensions.

In particular, as previously illustrated in FIG. 1B, the spacing between the geostationary positions of the satellites affects the angle with which signals are received from the satellites by the antenna and the points at which the signals are reflected by the reflector of the antenna. If the satellites are located at geostationary positions that are sufficiently spaced apart, the points of the signals from the satellites reflected by the reflector of the antenna will be spaced sufficiently apart such that conventional corrugated wave-guides may be used. For example, with reference to FIG. 1B, if the signals illustrated, 32 and 34, are from satellites that are spaced more than five (5) degrees of arc apart, the offset distance 46 between the points at which the signals are directed, 38 and 40, respectively, will be sufficiently large so that conventional wave-guide systems may be used at the points, 38 and 40, to communicate with the satellites.

Importantly, however, the two remaining wave-guides, 68 and 70, are configured to establish respective data communication links with satellites that are closer in angular .proximity to each other. Again with reference to FIG. 1B, if the satellites associated with wave-guides, 68 and 70, are located at geostationary positions that are within a range of up to 5 degrees of arc apart, the offset distance 46 between the points, 38 and 40, of the signals from the satellites is such that many conventional wave-guides are too large to be spaced sufficiently close together. As such, the wave-guides, 68 and 70, of the present invention, unlike the wave-guides, 64 and 66, must be configured in a compact manner such that they may be spaced in close proximity to one another to thereby establish respective data communication links with the closely angular spaced satellites.

For example, in one embodiment, the wave-guides, 68 and 70, may be located so as to establish respective data communication links with satellites that are located at geostationary positions that are within a range of 5 degrees or less angular distance apart. In this instance, the wave-guides must be located at a distance from each other within the range of up to 4 inches to establish respective data communication links with the satellites.

To address this problem, the antenna of the present invention provides various embodiments that allow for different communication scenarios based on the types of communication links formed with the closely spaced satellites. For example, in one embodiment, both of the satellites are used in one-way communication, in which signals are only received from both of the closely spaced satellites. In this embodiment, the antenna of the present invention uses two receive wave-guides that may be spaced in close proximity to each other.

Specifically, in this embodiment, the antenna of the present invention may use two solid dielectric filled wave-guides, which are formed of a hollow metallic structure filled with a solid dielectric material having a selected dielectric constant, for receiving signals from satellites that are located at geostationary positions spaced apart by an arc of five 5 degrees or less. For a given frequency band, the dielectric filled wave-guide has a diameter that is inversely related to the square root of the dielectric of the material from which the wave-guide is formed.

Specifically, in the instance that the wave-guide is a hollow wave-guide, the internal cavity will be filled with air having a dielectric constant of 1. As the size of the wave-guide is related to the dielectric constant of the material located in the hollow cavity of the wave-guide, the size of the hollow wave-guide will be dictated by the dielectric constant of the air in the cavity. However, if the hollow cavity of the wave-guide could be filled with a dielectric material having a dielectric constant other than air, (such as in the case of the present invention), the dimensions of the feed can then be altered. In this case, preferably the hollow wave-guide will be filled with a dielectric material having a dielectric constant greater than air to thereby decrease the dimensions of the feed.

As an example, a typical hollow wave-guide used for receiving signals in the Ku-band frequency range has a diameter of 0.75 inches. This diameter is a function of the dielectric constant of the air located in the cavity of the hollow feed. Given a diameter of 0.75, in some instances, this diameter may be too large for placing the wave-guides of the present invention in close proximity to each other.

As such, to provide a wave-guide for use in the Ku-band to receive signals that has a decreased diameter, the present invention uses a hollow wave-guide that is filled with a dielectric material having a higher dielectric than air. By using a dielectric filled wave-guide, the diameter of the wave-guide may be decreased by using a wave-guide made from a material having an increased dielectric constant. In other words, the diameter of the hollow wave-guide filled with a given dielectric material is equal to:

$$\text{Diameter} = \frac{0.75}{\sqrt{Dielectric.Const.}}$$

Thus, if the hollow wave-guide is filled with a dielectric material having a dielectric constant of approximately 2.3, the diameter of the wave-guide can be decreased to approximately 0.693 inches, as opposed to the conventional 0.75 inch diameter of the hollow wave-guide. In light of this, in instances where one-way communication is established with both closely spaced satellites, the two wave-guides of the antenna can be sufficiently sized by forming the wave-guides from material having an increased dielectric constant.

In addition, even though these types of feeds are not normally used for two-way communication, they can be used for such purpose. In light of this, two dielectric filled feeds could be spaced in close proximity to each other, where either one or both are used for two-way communication. In this instance, due to their proximity to one another, proper isolation between the feeds would be warranted.

The above discussion of configuring the diameter of the dielectric filled wave-guide is illustrated with reference to wave-guides configured to operate in the Ku-band, where wave-guide diameter is typically 0.75 inches. This is merely an example illustrating the method of configuring the dielectric filled wave-guide for a particular application and should not limit the use of this for determination of wave-guide size and content for other frequency bands, such as the Ka-band, as an example.

As will be understood, the particular material that is used to fill the wave-guide will depend on the required dimensions needed to communicate with the closely spaced satellites. The closer the satellites are located with respect to each other, the closer the dielectric filled wave-guides will need to be to be located to each other. In this instance, the wave-guides will need to be smaller in dimension, and as such, made from a material having a larger dielectric constant.

It must be understood that the dielectric filled wave-guides can be formed using any desired dielectric material given the restraints in size of the wave-guide required for the application. For example, dielectric materials ranging in dielectric constant from 1–14.0 can be used. However, because of cost and other factors associated with materials having higher dielectric constants, the dielectric filled wave-guides are typically formed using polyethylenes and polypropylenes. These materials provide dielectric constants in the range of 2–4 and are generally cost effective. Further, the dielectric filled wave-guides are typically formed of a metallic hollow conduit structure. These dielectric filled wave-guides are sometimes referred to as poly-rods.

Also, the example above illustrates an instance where the dielectric filled wave-guide is circular. However, in some instances the dielectric could be any shape, such as square, rectangular, elliptical, etc. In these instances, the dimensions of the dielectric filled wave-guide is inversely proportional to the square root of the dielectric material of which it is filled.

In addition to providing one-way communication with closely spaced satellites, the antenna of the present invention may also be used in instances where one of the communication links is a two-way communication link, in which one of the wave-guides both receives signals from and transmits signals to its corresponding satellite. In this instance, as with the previous embodiment, both wave-guides must be dimensioned such that they may be placed in close proximity to one another. In light of this, a solid dielectric filled wave-guide is again used for the one-way communication wave-guide. As before, the diameter of the dielectric filled wave-guide can be changed to place it in closer proximity to the other wave-guide.

However, since dielectric filled wave-guides are typically used only for signal reception, a different type of wave-guide is used for the two-way communication wave-guide For example, in one embodiment, the antenna of the present invention includes a hollow air-filled wave-guide for establishing a two-way communication link with a satellite located in close proximity to the satellite associated with the dielectric filled wave-guide. The air-filled hollow wave-guide structure is defined by opposing pairs of metallic walls. Such hollow air-filled wave-guide structures are typically of a corrugated construction. In accordance with preferred embodiments of the invention, one pair of walls is more closely spaced apart than the other pair of walls to define a rectangular configuration. For example, the hollow rectangular wave-guide is a transmitting and receiving wave-guide having a greater height, (i.e., approximately 2.8 inches), and a reduced width, (i.e., approximately 1.4 inches). The reduced width of the corrugated wave-guide allows for close placement of the solid dielectric wave-guide closely beside it with the axes of the two wave-guides in close proximity, e.g. no more than 2 inches, for establishing respective communication links with both of the closely spaced satellites.

Preferably, the hollow rectangular wave-guide is placed at the focal point of the reflector. This ensures that the signals from the satellite are focused on the hollow rectangular wave-guide and that signals from the wave-guide to the satellite are properly focused. Additionally, the curvature of the reflector may be designed as known to those skilled in the art, such that the signals provided by the reflector to the rectangular wave-guide have a narrower beam width. This, in turn allows, the dimensions of the wave-guide to be decreased.

As an example of this embodiment of the present invention, FIGS. 3, 4A, 4B illustrate two wave-guides according to one embodiment of the present invention that are configured to establish respective data communication links with respective satellites located approximately 2 degrees apart. In this embodiment, the first wave-guide 68 is a corrugated hollow rectangular wave-guide for establishing a two-way communication link with one of the satellites, and the second wave-guide 70 is a solid dielectric filled wave-guide for establishing one-way communication with the second satellite. Because the satellites are within approximately 2° of each other, the wave-guides must be spaced within 0 to 2 inches from each other, (from center to center), to establish proper data communication links with the satellites.

In this embodiment, the wave-guides communicate with the satellites using frequencies in the Ku-band. As such, to establish the respective data communication links, the hollow rectangular wave-guide has a height of approximately 2.8 inches and a width of 1.4 inches and is placed at the focal point of the reflector. Further, the solid dielectric-filled wave-guide is made from polypropylene and has a dielectric constant of 2.3 and a diameter of 0.69. In this embodiment, due to the reduced sizes of the two wave-guides, they can be placed within the range of up to 2 inches apart, center to center, to establish communication links with the two closely spaced satellites.

It must be understood that that the above illustrated embodiment is just one example of the configuration of the antenna of the present invention. The concepts illustrated by this example can be used to construct an antenna to establish communication links with satellites having different geostationary positions and different spacing between the satellites. For example, the above embodiment may be used to establish communication links with satellites spaced apart by up to 5 degrees and even for satellites that spaced further apart, if desired. Further, the antenna can be designed for different frequency bands.

In addition to providing antennas for establishing one-way communication with closely spaced satellites and antennas for establishing both one-way and two-way communication, the present invention also provides antennas for establishing individual two-way communication links with more than one closely spaced satellite. For example, in another embodiment, of the antenna of the present invention is configured to establish respective two-way communication links with two closely spaced satellites, where both closely spaced wave-guides both receive signals from and transmit signal to the satellites. In this embodiment of the present invention, both of the wave-guides are typically corrugated wave-guides, where the corrugated wave-guide associated with the more critical communication link is placed at the focal point of the reflector. Further, the reflector is designed to provide a narrow beam width to both of the corrugated feeds, thereby allowing the feeds to have smaller dimensions. Given the decreased width of the corrugated wave-guides, the two wave-guides may be placed in close proximity to each other to establish communication links with the closely spaced satellites.

As illustrated in the embodiments above, antennas can be fabricated according to the present invention to provide respective one-way communication links with closely spaced satellites, respective two-way communication with closely spaced satellites, and both respective one-way and two-way communication links with closely spaced satellites. It must be understood that in the above embodiments, antennas are discussed for use with two closely spaced satellites, however, it should be understood that the antennas of the present invention can be configured for use with a plurality of closely spaced satellites. In this instance, the antennas will include a plurality of closely spaced wave-guides each configured to provide either a one or two-way communication link with a respective one of the plurality of closely spaced satellites. Further, as illustrated in FIGS. 3, 4A, and 4B the antennas of the present invention may include some closely spaced wave-guides for communicating with closely spaced satellites and some additional wave-guides which are spaced further apart from one another for communicating with satellites that are spaced further apart.

As discussed in the various embodiments above, the antenna of the present invention includes two or more antenna wave-guides located in close proximity to each other for establishing communication links with closely spaced satellites. Given the close proximity of the wave-guides, in some embodiments the antenna includes a multiplexer structure for supporting and positioning the wave-guides with respect to the reflector of the antenna. Specifically, with reference to FIG. 3 in one embodiment, the antenna of the present invention includes a multiplexer structure 72 to which feedhorn sections, 68 and 70, are connected. The multiplexer structure of this embodiment is a common structure to which both feedhorn sections are connected.

In some embodiments of the present invention, the multiplexer structure is similar to an ortho-mode transducer (OMT), which allows for propagation of both transmit and receive signals in the multiplexer structure. With reference to FIG. 3, in this embodiment, the multiplexer structure separates the paths of the received and transmitted signals by providing transmit 74 and receive, 76 and 78, wave-guide sections connected to the respective feedhorn sections, 68 and 70. The transmit wave-guide section is used in conjunction with a feedhorn section for two-way communication of signals and provides signals from a transmitter connected to the transmit wave-guide a point 80 to the feedhorn section for transmission to the satellite associated with the wave-guide. The receive wave-guide sections are used to transmit signals received by the wave-guide to low noise blocks (LNB) 82 for amplifying and filtering the received signals prior to use by a communication unit, such as a TV, computer, etc., connected to the antenna. It must be understood that the receive wave-guides may be connected of different types of receiver devices. For example, they may be connected to an LNB for signal filtering and amplification, they may be connected directly to communication units or other similar systems. As such, the term receiver as used herein may include many of these systems for processing and/or using the received signals.

With reference to FIG. 5, an example of a configuration for the multiplexer structure operating as an OMT is illustrated. Specifically, FIG. 5 is a cross-sectional view of a multiplexer structure 72 for connecting the first feedhorn section 68 with a transmitter and receiver via the transmit wave-guide 74 and the receive wave-guide 76. Specifically, the multiplexer structure includes a port 80 for connection to the feed section 68, a transmit port 82 for connection to a transmitter, and a receive port 84 for connection to a receiver. Connected to the transmit port 82 of the multiplexer structure is the transmit wave-guide 74 for connection to a transmitter, not shown. Further, the receive wave-guide 76 is connected to the receive port of the multiplexer structure to a receiver, not shown. In this configuration, signals received by the feedhorn section 68 propagate along the central portion 86 of the multiplexer structure and are provided to the receive wave-guide 76 via the receive port 84. Further, signals received by the transmit wave-guide 74 from a transmitter are provided to the central portion 86 of the multiplexer structure via the transmit port 82 of the multiplexer structure, where the signal is, in turn, provided to the feedhorn section 68 for transmission.

In addition to providing a common structure for mounting the feedhorn sections and for providing transmit signals to and receipt of signals from the feedhorn sections, the multiplexer structure may also provide signal isolation for the transmit and receive wave-guide sections connected to the feedhorn sections. Specifically, in typical embodiments, signals transmitted to the satellites are typically transmitted within a first range of frequencies and signals received from the satellites are received within a second range of frequencies. Given that the receive and transmit wave-guide sections are both commonly connected to the feedhorn sections, without isolation, signals propagating along the transmit wave-guide section in the first frequency range will be received on the receive wave-guide section and provided to the communication unit connected to the antenna. These signals may disrupt operation of the communication unit. Likewise, signals received by the feedhorn section from the satellite in the second range of frequencies will propagate along the transmit wave-guide section associated with the feedhorn section absent isolation. These signals may disrupt the transmitter.

In light of this, in one embodiment of the present invention, the multiplexer structure further includes filters in the transmit and receive wave-guide sections. The filters in the receive wave-guide sections filter frequencies in the first frequency range, so that signals provided to the feedhorn section by the transmit wave-guide section do not propagate along the receive wave-guide sections. Likewise, the filter on the transmit wave-guide filters frequencies in the second range of frequencies, so that signals received by the feedhorn section do not propagate along the transmit wave-guide section. With regard to FIG. 5, the transmit wave-guide 74 connected to the first feedhorn 68 via the multiplexer structure 72 may have it inner-surfaces configured and dimensioned to filter frequencies in the second range, while the receive wave-guide 76 may have it inner-surfaces configured and dimensioned to filter frequencies in the first range.

An additional function of the filters is to prevent signals transmitted by one feedhorn section and received by an adjacent feedhorn section from propagating along the receive wave-guide section of the adjacent feedhorn section. Specifically, due to the close proximity of some of the feedhorn sections on the antennas of the present invention, signals transmitted by one feedhorn section to its associated satellite may also be received by adjacent feedhorn sections. In these instances, the filters in the receive wave-guide sections not only prevent signals transmitted by their associated feedhorn section from propagating along the receive wave-guide section, but also they prevent signals received from adjacent feedhorn sections from propagating along the receive wave-guide sections. This aspect of the of filters becomes more advantageous the closer the feedhorn sections are spaced relative to each other.

As an example of the filtering aspect of the present invention, in one embodiment, the antenna of the present invention can be used to communicate with a satellite using frequencies in the Ku-band, in which signals are transmitted from the satellites to the antennas using frequencies in the range of 10.95–12.75 gigaHertz and signals are transmitted to the satellites using frequencies in the range of 13.75–14.5 gigaHertz. In this embodiment, the multiplexer structure of the present invention includes filters connected to the transmit wave-guide sections for filtering frequencies in the range of 10.95–12.75 gigaHertz, such that received signals do not propagate along the transmission wave-guide sections. Further, the multiplexer structure of the present invention includes filters in the receive wave-guide sections for filtering frequencies in the range of 13.75–14.5 gigaHertz, such that transmitted signals do not propagate along the receive wave-guide sections.

In an alternative embodiment, data communication with the satellites is performed using signals in the Ka-band. In this embodiment, signals are transmitted by the satellites to the antenna using frequencies in the range of 19.7–20.2 gigaHertz and signals are transmitted to the satellites using frequencies in the range of 29.5–30.0 gigaHertz. In this embodiment, the multiplexer structure of the present invention includes filters connected to the transmit wave-guide sections for filtering frequencies in the range of 19.7–20.2 gigaHertz, such that received signals do not propagate along the transmission wave-guide sections. Further, the multiplexer structure of the present invention includes filters connected to the receive wave-guide sections for filtering frequencies in the range of 29.5–30.0 gigaHertz, such that transmitted signals do not propagate along the receive wave-guide sections.

In some additional embodiments, one wave-guide may communicate with its associated satellite using one frequency band, while an adjacent wave-guide may communicate with its associated satellite using a different frequency band. Further, one wave-guide may use several alternative frequency bands for communicating with its associated satellite. In these embodiments, the multiplexer structure of the present invention will include appropriate filters connected to the receive and transmit wave-guide sections of the feedhorn sections. For example, the receive wave-guide sections may include filters for filtering frequencies used by its associated feedhorn section for transmitting signals and filters for filtering frequencies used by adjacent feedhorn sections for transmitting signals. Further, the transmit wave-guide sections may include filters for filtering frequencies used by its associated feedhorn section to receive signals and filters for filtering frequencies used by adjacent feedhorn sections to receive signals.

It must be noted here that the antenna of the present invention should not be limited to any particular frequency band for communication. Although the above examples relate to the Ka-band and Ku-band, the antennas of the present invention may be used to communicate within any appropriate frequency band. For a desired frequency band, the wave-guides and filters will be appropriately selected to provide proper signal reception, transmission, and isolation.

Further, in the above description, the filters are discussed as separate components connected to the receive and transmit wave-guide sections. It must be understood, however, that the filters may be integral portions of the transmit and receive wave-guide sections. Specifically, as known to those skilled in the art, signal filtering is accomplished by the shape of the filter and the type of material that forms the filter. In preferred embodiments, the receive and transmit wave-guide sections themselves are shaped and made from proper material to provide the desired filtering of the signals. The shape and types of material is dependent on the desired filtering characteristics.

In addition to providing a multibeam antenna having at least two wave-guides that can be spaced in close proximity to each other, the present invention also provides an antenna and multiplexer structure that can increase the performance of a particular communication link between a wave-guide and its associated satellite. Specifically, in some instances, it may be advantageous to provide an increased high performance data communication link with a particular satellite for data communication. For example, with regard to data communication of Internet data via satellites, the Federal Communications Commission requires increased data communication performance. To meet this requirement, the antenna and multiplexer structure of one embodiment of the present invention includes a wave-guide directed at the focal point of the reflector. In turn, the remaining wave-guides are spaced at distances from the center wave-guide, such that the remaining wave-guides scan the received beam at angles based on the angular offset between the satellite to which the wave-guides are associated with and the satellite associated with the center wave-guide.

For example, with reference to FIGS. 3, 4A, and 4B the wave-guide 68 may be positioned at the focal point of the reflector 62 of the antenna 60 to increase the performance of the data communication link with the satellite associated with wave-guide 68. Because the wave-guide 68 is placed at the focal point of the reflector 62, the wave-guide will have a higher performance data link with the satellite. Additionally, the remaining wave-guides, 64, 66, and 70, are spaced at distances from the center wave-guide 68, such that the wave-guides scan the received beam at angles based on the angular offset between the satellite to which the wave-guides are associated with and the satellite associated with the center wave-guide 68. For instance, in this embodiment, the satellite associated with the wave-guide 70 is approximately 2° with respect to the satellite associated with the wave-guide 68. As such, the wave-guide 70 is spaced apart from the center wave-guide 68 by a distance such that the wave-guide 70 scans the received beam at 2° off axis.

In addition to providing antennas and multiplexer structures, the present invention also provides methods for constructing and using antennas having closely spaced wave-guides for communicating with satellites located at geostationary positions that are in close proximity to each other. For example, FIGS. 3, 4A, and 4B illustrate one embodiment of the antenna of the present invention in which one wave-guide 68 is used for two-way communication with a satellite and a second wave-guide 70, spaced in close proximity to the first wave-guide, for one-way communication with a second satellite spaced in close proximity to the first satellite. As can be seen from these figures, these antennas are constructed by first selecting appropriate wave-guides having dimensions that will allow the wave-guides to be closely spaced together.

For example, in embodiments where the wave-guides are used for one-way communication with closely spaced satellites, the wave-guides are typically poly-rod wave-guides or similar wave-guides that have dimensions that can be altered by forming the wave-guides from a material having an appropriate dielectric constants. Further, if one of the wave-guides in used in two-way communication, a corrugated wave-guide is typically used for this wave-guide.

After the wave-guides have been chosen, they are connected to the multiplexer structure 72, which is connected to the reflector 62 of the antenna 60 by at least one boom arm 84. Importantly, the wave-guides are connected to the multiplexer structure at locations corresponding to the point at which the signals associated with the wave-guides are reflected by the reflector. The offset distance between the points will determine the dimensions of the wave-guides needed to properly communicate with the closely spaced satellites.

The multiplexer structure includes transmit wave-guides and receive wave-guides connected to the wave-guides. For example, in the embodiment of FIGS. 3, 4A, and 4B, the first wave-guide 68 is used for two-way communication with its associated satellite and the second wave-guide 70 is used for one-way communication. In this example, the multiplexer structure 72 includes both a receive 76 and a transmit 74 wave-guide connected to the first wave-guide 68. Further, a receive wave-guide 78 is connected to the second wave-guide 70. In this embodiment, the transmit and receive wave-guides are properly structured to provide filtering of signals thereby isolating the transmit wave-guide from received signals and the receive wave-guides from transmitted signals.

Connected to the receive wave-guides are low noise blocks 82 (LNB) for amplifying and filtering the received signals prior to application of the signals to a communication unit, such as a TV, computer, etc. Further, connected to the transmit wave-guide 74 of the first wave-guide 68 is a transmitter for supplying signals to the first wave-guide for transmission to its associated satellite. As can be seen, the antenna illustrated in FIGS. 3, 4A, 4B also includes additional wave-guides, 64 and 66, positioned with respect to the reflector for communicating with additional satellites.

In use, the antenna structure is initially positioned in a location and the reflector is positioned relative to the geostationary location of the satellites. The transmitter and LNBs of the antenna are then connected to the users communication units. For example, some of the wave-guides may be connected to a computer or TV for data communication with the satellites. Because the user is employing an antenna having multiple wave-guides for communication with the different satellites of interest, the user does not need multiple antennas.

In the above various embodiments, the antenna is illustrated as having only one reflector. However, it must be understood that the above embodiments can be used with an antenna having multiple reflectors, such as a dual optics antenna.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A multibeam antenna for establishing individual communication links with at least first and second satellites located at different geostationary positions and in close angular proximity to each other, comprising:

a reflector that directs signals transmitted to or from the first and second satellites;

a first wave-guide positioned with respect to said reflector for establishing a communication link with the first satellite; and a second wave-guide positioned alongside said first wave-guide and being arranged with respect to said reflector so as to establish a communication link with the second satellite, wherein at least one of said wave-guides is capable of both transmitting and receiving signals and comprises:

a feedhorn section having one end oriented for receiving or transmitting signals;

a transmit wave-guide section communicatively connecting with said feedhorn section for connecting to a transmitter; and a receive wave-guide section communicatively connecting with said feedhorn section for connecting to a receiver, and at least one of said wave-guides has a dielectric constant greater than that of air.

2. An antenna according to claim 1, wherein said at least one wave-guide which has a dielectric constant greater than air is filled with a solid dielectric material.

3. An antenna according to claim 2, wherein said at least one wave-guide comprises a hollow tubular metallic conduit filled with a solid dielectric material.

4. An antenna according to claim 3, wherein the other one of said wave-guides comprises a hollow air-filled metallic wave-guide.

5. An antenna according to claim 4, wherein said metallic wave-guide is of rectangular cross-section.

6. An antenna according to claim 1, wherein said first and second wave-guides have respective axes which are spaced apart from each other by a distance of no more than 2 inches.

7. An antenna according to claim 1, wherein said first wave-guide comprises an air-filled hollow wave-guide structure defined by metallic walls, and said second wave-guide is connected to a wall of said first wave-guide and comprises a hollow tubular metallic conduit filled with a solid dielectric material.

8. An antenna according to claim 7, wherein said first wave-guide is of a rectangular configuration defined by first and second pairs of opposed walls, with one pair of opposed walls being more narrowly spaced apart from one another than the other pair of opposed walls, and wherein the second wave-guide is connected to one of the more narrowly spaced walls so that the axes of the first and second wave-guides are closely spaced apart.

9. An antenna according to claim 8, wherein said first and second wave-guides have respective axes which are spaced apart from each other by a distance of no more than 2 inches.

10. An antenna according to claim 7, wherein said first wave-guide is used for both transmitting and receiving signals and comprises:

a feedhorn section having one end oriented for receiving or transmitting signals, a transmit wave-guide section communicatively connecting with said feedhorn section for connecting to a transmitter; and a receive wave-guide section communicatively connecting with said feedhorn section for connecting to a receiver.

11. An antenna according to claim 7, wherein both said first and second wave-guides are used for both transmitting and receiving signals, and wherein each of said wave-guides comprises:

a feedhorn section having one end oriented for receiving or transmitting signals, a transmit wave-guide section communicatively connecting with said feedhorn section for connecting to a transmitter; and a receive wave-guide section communicatively connecting with said feedhorn section for connecting to a receiver.

12. An antenna according to claim 1, wherein said first wave-guide is positioned with respect to said reflector such that said first wave-guide is directed at a focal point of said reflector to thereby increase communication performance between said first wave-guide and the first satellite, and wherein said second wave-guide is positioned at an offset distance from said first wave-guide for establishing communication with the second satellite.

13. An antenna according to claim 1, wherein at least one of said wave-guides has a cross-sectional shape selected from group consisting of square, circular, rectangular, and elliptical.

14. An antenna according to claim 1, wherein said first wave-guide is positioned with respect to said reflector such that said first wave-guide is directed at a focal point of said reflector to thereby increase communication performance between said first wave-guide and the first satellite, and wherein said second wave-guide is positioned at an offset distance from said first wave-guide for establishing communication with the second satellite, wherein said first and second wave-guide are independent wave-guides and said second wave-guide is positioned relative to said first wave-guide independent of slicing away portions of either of said first and second wave-guides.

15. An antenna according to claim 1, wherein said first wave-guide is positioned with respect to said reflector such that said first wave-guide is directed at a focal point of said reflector, and wherein said second wave-guide is positioned at an offset distance from said first wave-guide for establishing communication with the second satellite, wherein at least one of said first and second wave-guides is formed of a dielectric material having a selected dielectric constant such that said first and second wave-guides can be positioned relative to each other independent of slicing away portions of either of said first and second wave-guides.

16. An antenna according to claim 1, wherein said first wave-guide is positioned with respect to said reflector such that said first wave-guide is directed at a focal point of said reflector, and wherein said second wave-guide is positioned at an offset distance from said first wave-guide for establishing communication with the second satellite, wherein said second wave-guide is formed of a dielectric material having a selected dielectric constant such that said second wave-guide is dimensioned so as to be positioned next to said first wave-guide independent of slicing away portions of either of said first and second wave-guides.

17. A multibeam antenna for establishing individual communication links with at least first and second satellites located at different geostationary positions and in close angular proximity to each other, wherein signals transmitted to the first satellite are transmitted within a first range of frequencies and signals received from the first satellite are received within a second range of frequencies, said antenna comprising:

a reflector that directs signals transmitted to or from the first and second satellites;

a first wave-guide positioned with respect to said reflector for establishing a communication link with the first satellite, said first wave-guide comprising:

a feedhorn section having one end oriented for receiving or transmitting signals, a transmit wave-guide section communicatively connecting with said feedhorn section for connecting to a transmitter;

a receive wave-guide section communicatively connecting with said feedhorn section for connecting to a receiver;

a first filter operatively associated with said transmit wave-guide section for filtering out frequencies in the second range; and a second filter operatively associated with said receive wave-guide for filtering out frequencies in the first range; and a second wave-guide positioned alongside said first wave-guide and being arranged with respect to said reflector so as to establish a communication link with the second satellite, and wherein at least one of said wave-guide has a dielectric constant greater than that air.

18. An antenna according to claim 17, additionally including a filter operatively associated with said second wave-guide for filtering out frequencies in the first range.

19. An antenna according to claim 18, wherein said first wave-guide is capable of receiving Ka-band signals in the range of 19.7–20.2 gigaHertz and transmitting Ka-band signals in the range of 29.5–30.0 gigaHertz, wherein said filter of said transmit wave-guide section filters frequencies in the range of 19.7–20.2 gigaHertz, such that signals received by said first wave-guide do not propagate along said transmit wave-guide section, and wherein said filter of said receive wave-guide and said filter of said second wave-guide filter frequencies in the range of 29.5–30.0 gigaHertz, such that signals transmitted by said first wave-guide do not propagate along said receive wave-guides.

20. An antenna according to claim 12, wherein said first wave-guide is capable of receiving Ku-band signals in the range of 10.95–12.75 gigaHertz and transmitting Ku-band signals in the range of 13.75–14.5 gigaHertz, wherein said filter of said transmit wave-guide filters frequencies in the range of 10.95–12.75 gigaHertz, such that signals received by said first wave-guide do not propagate along said transmit wave-guide section, and wherein said filter of said receive wave-guide section and said filter of said second wave guide filter frequencies in the range of 13.75–14.5 gigaHertz, such that signals transmitted by said first wave-guide do not propagate along said receive wave-guides.

21. A multibeam antenna for establishing individual communication links with at least first and second satellites located at different geostationary positions and in close angular proximity to each other, comprising:

a reflector that directs signals transmitted to or from the first and second satellites;

a first wave-guide used for both transmitting and receiving signals positioned with respect to said reflector for establishing a communication link with the first satellite, wherein said first wave-guide comprises:

a feedhorn section having one end oriented for receiving or transmitting signals;

a transmit wave-guide section communicatively connecting with said feedhorn section for connecting to a transmitter;

a receive wave-guide section communicatively connecting with said feedhorn section for connecting to a receiver; and a multiplexer connecting said transmit wave-guide section and said receive wave-guide section respectively to said feedhorn section; and a second wave-guide positioned alongside said first wave-guide and being arranged with respect to said reflector so as to establish a communication link with the second satellite, and wherein at least one of said wave-guide has a dielectric constant greater than that of air.

22. A multibeam antenna for establishing individual communication links with at least first and second satellites located at different geostationary positions that are in the range of up to 5 degrees of arc apart, comprising:

a reflector that directs signals transmitted to or from the first and second satellites;

a first wave-guide positioned with respect to said reflector for establishing a communication link with the first satellite and comprising an air-filled hollow wave-guide defined by metallic walls; and a second wave-guide positioned alongside said first wave-guide and connected to a wall of said first wave-guide, said second wave-guide being arranged with respect to said reflector so as to establish a communication link with the second satellite, and said second wave-guide comprising a hollow tubular metallic conduit filled with a solid dielectric material, wherein at least one of said wave-guides is capable of both transmitting and receiving signals and comprises:

a feedhorn section having one end oriented for receiving or transmitting signals;

a transmit wave-guide section communicatively connecting with said feedhorn section for connecting to a transmitter; and a receive wave-guide section communicatively connecting with said feedhorn section for connecting to a receiver.

23. An antenna according to claim 22, wherein said first wave-guide is of a rectangular configuration defined by first and second pairs of opposed walls, with one pair of opposed walls being more narrowly spaced apart from one another than the other pair of opposed walls, and wherein the second wave-guide is connected to one of the more narrowly spaced walls so that the axes of the first and second wave-guides are closely spaced apart.

24. An antenna according to claim 22, wherein said first wave-guide is used for both transmitting and receiving signals and comprises a feedhorn section having one end oriented for receiving or transmitting signals, a transmit wave-guide section communicatively connecting with said feedhorn section for connecting to a transmitter; and a receive wave-guide section communicatively connecting with said feedhorn for connecting said to a receiver.

25. An antenna according to claim 22, wherein at least one of said wave-guides has a cross-sectional shape selected from group consisting of square, circular, rectangular, and elliptical.

26. An antenna according to claim 22, wherein both said first and second wave-guides are used for both transmitting and receiving signals, and wherein each of said wave-guides comprises:

a feedhorn section having one end oriented for receiving or transmitting signals, a transmit wave-guide section communicatively connecting with said feedhorn section for connecting to a transmitter; and a receive wave-guide section communicatively connecting with said feedhorn section for connecting to a receiver.

27. A multibeam antenna for establishing individual communication links with at least first and second satellites located at different geostationary positions that are in the range of up to 5 degrees of arc apart, wherein signals transmitted to the first satellite are transmitted within a first range of frequencies and signals received from the first satellite are received within a second range of frequencies, said antenna comprising:

a reflector that directs signals transmitted to or from the first and second satellites;

a first wave-guide positioned with respect to said reflector for establishing a communication link with the first satellite and comprising an air-filled hollow wave-guide defined by metallic walls, said first wave-guide comprising:

a feedhorn section having one end oriented for receiving or transmitting signals, a transmit wave-guide section communicatively connecting with said feedhorn section for connecting to a transmitter, a receive wave-guide section communicatively connecting with said feedhorn section for connecting to a receiver;

a first filter operatively associated with said transmit wave-guide section for filtering out frequencies in the second range; and a second filter operatively associated with said receive wave-guide section for filtering out frequencies in the first range; and a second wave-guide positioned alongside said first wave-guide and connected to a wall of said first wave-guide, said second wave-guide being arranged with respect to said reflector so as to establish a communication link with the second satellite, and said second wave-guide comprising a hollow tubular metallic conduit filled with a solid dielectric material.

28. An antenna according to claim 27, additionally including a filter operatively associated with said second wave-guide for filtering out frequencies in the first range.

29. An antenna according to claim 27, including at least one additional wave-guide positioned with respect to said reflector for establishing a communication link with at least one additional satellite located at different geostationary positions.

30. A multibeam antenna for establishing individual communication links with at least first and second satellites located at different geostationary positions and in close angular proximity to each other, comprising:

a reflector that directs signals transmitted to or from the first and second satellites;

a rectangular wave-guide positioned with respect to said reflector for establishing a communication link with the first satellite using linear polarized signals; and a circular wave-guide positioned alongside said rectangular wave-guide and being arranged with respect to said reflector so as to establish a communication link with the second satellite using circular polarized signals, and wherein at least on of said wave-guides is a hollow metallic conduit filled with a solid dielectric material.

31. A multiplexer structure for use in a multibeam antenna, comprising:

a first feedhorn section having a hollow air-filled metallic structure;

a second feedhorn section having a hollow tubular metallic conduit structure filled with a solid dielectric material, wherein said first and second feedhorn sections have respective axes which are spaced apart from each other by a distance of no more than 2 inches;

a transmit wave-guide section communicatively connecting with said first feedhorn section for connecting to a transmitter; and respective receive wave-guide sections communicatively connecting with said first and second feedhorn sections for connecting to respective receivers.

32. A multibeam antenna for establishing individual communication links with at least first and second signal sources located at different positions in close angular proximity to each other, comprising:

a reflector that directs signals transmitted to or from the first and second signal sources;

a first wave-guide positioned with respect to said reflector for establishing a communication link with the first signal source; and a second wave-guide positioned alongside said first wave-guide and being arranged with respect to said reflector so as to establish a communication link with the second signal source, wherein at least one of said wave-guides is capable of both transmitting and receiving signals and comprises:

a feedhorn section having one end oriented for receiving or transmitting signals;

a transmit wave-guide section communicatively connecting with said feedhorn section for connecting to a transmitter; and a receive wave-guide section communicatively connecting with said feedhorn section for connecting to a receiver, and at least one of said wave-guide has a dielectric constant greater than that of air.

33. A mulitibeam antenna for establishing individual communication links with at least first and second signal sources located at different positions in close angular proximity to each other, wherein signals transmitted to the first signal source are transmitted within a first range of frequencies and signals received from the first signal source are received within a second range of frequencies, said antenna comprising:

a reflector that directs signals transmitted to or from the first and second signal sources;

a first wave-guide positioned with respect to said reflector for establishing a communication link with the first signal source, said first wave-guide comprising:

a feedhorn section having one end oriented for receiving or transmitting signals, a transmit wave-guide section communicatively connecting with said feedhorn section for connecting to a transmitter;

a receive wave-guide section communicatively connecting with said feedhorn section for connecting to a receiver;

a first filter operatively associated with said transmit wave-guide section for filtering out frequencies in the second range; and a second filter operatively associated with said receive wave-guide for filtering out frequencies in the first range; and a second wave-guide positioned alongside said first wave-guide and being arranged with respect to said reflector so as to establish a communication link with the second signal source, and wherein at least one of said wave-guides has a dielectric constant greater than that of air.

* * * * *

UNITED STATES PATENT AND TRADEMARK OFFICE

CERTIFICATE OF CORRECTION

PATENT NO. : 6,480,165 B2
DATED : November 12, 2002
INVENTOR(S) : Moheb et al.

It is certified that error appears in the above-identified patent and that said Letters Patent is hereby corrected as shown below:

Title page,
Item [56], References Cited, OTHER PUBLICATIONS,
"Kuband" should read -- Ku-band --;
Insert the following:
-- Hamid, M.A.K. et al., *A Dielectric-Loaded Circular Waveguide Antenna*, IEEE Trans. Antennas Propagat, Vol. AP-20, pp. 96-97, Jan 1972.
Salema et al., *Solid Dielectric Horn Antennas*, pp. 4-6 (1998).
Johnson et al., *Antenna Engineering Handbook* (2nd Ed.) pp. 21-23 (1984).
James, J.R., *Engineering Approach to the Design of Tapered Dielectric-Rod and Horn Antennas*, Radio Electron Eng., Vol. 42, pp. 251-259, pp. 371-379, (June 1972). --.

Column 17,
Line 38, begin new sub-paragraph after "signals,";
Line 64, "wave-guide" should read -- wave-guides --.

Column 18,
Line 53, "wave-guide" should read -- wave-guides --;
Line 54, after "that" insert -- of --.

Column 19,
Line 3, "claim 12" should read -- claim 18 --;
Line 39, "wave-guide" should read -- wave-guides --.

Column 20,
Line 28, begin new sub-paragraph after "signals".

Column 22,
Line 16, "wave-guide" should read -- wave-guides --.

Signed and Sealed this

Third Day of June, 2003

JAMES E. ROGAN
*Director of the United States Patent and Trademark Office*